US006205833B1

(12) United States Patent
Kalkenings et al.

(10) Patent No.: US 6,205,833 B1
(45) Date of Patent: Mar. 27, 2001

(54) COLD PILGER ROLLING TOOL FOR PRODUCING INTERNALLY RIBBED TUBES

(75) Inventors: Peter Kalkenings, Aachen; Horst Stinnertz, Willich, both of (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/521,348

(22) Filed: Mar. 9, 2000

(30) Foreign Application Priority Data

Mar. 9, 1999 (DE) ..... 199 11 677

(51) Int. Cl.[7] ..... B21B 17/10
(52) U.S. Cl. ..... 72/208
(58) Field of Search ..... 72/208, 209, 214

(56) References Cited

U.S. PATENT DOCUMENTS 4,562,713 * 1/1986 Kondoh ..... 72/214
4,713,955 * 12/1987 Peytavin ..... 72/208
4,966,022 * 10/1990 Stinnertz ..... 72/208
4,995,252 * 2/1991 Robertson et al. ..... 72/194

FOREIGN PATENT DOCUMENTS 58-173022 * 10/1983 (JP) ..... 72/214

* cited by examiner

*Primary Examiner*—Rodney A. Butler
(74) *Attorney, Agent, or Firm*—Cohen, Pontani, Lieberman & Pavane

(57) ABSTRACT

A cold pilger rolling tool for producing internally ribbed tubes uses a cold pilger step rolling process in a rolling stand that is movable back and forth in a direction of rolling and has rolls of a tapered design. The rolls of the stand roll along a material with an alternating direction of rotation. The tool includes a cold pilger rolling mandrel which tapers. The tool further comprises an extension plug mounted coaxially and rotatably at a free end of the cold pilger rolling mandrel and in which a negative of the helical internal ribbing which is to be produced is machined.

4 Claims, 1 Drawing Sheet

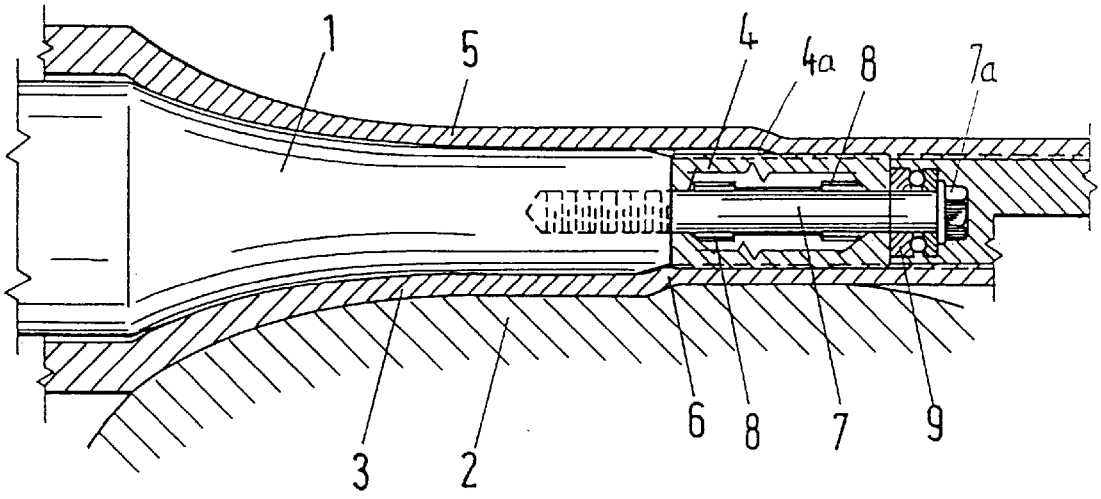
1
5
4
4a
8
7a
3
2
6
8
7
9

COLD PILGER ROLLING TOOL FOR PRODUCING INTERNALLY RIBBED TUBES

BACKGROUND OF THE INVENTION

1. Field of the Invention

The invention relates to a cold pilger rolling tool for producing internally ribbed tubes using the cold pilger step rolling process in a rolling stand which is movable back and forth in the direction of rolling and has rolls which are of tapered design and roll along the material to be rolled with an alternating direction of rotation, the tool including a cold pilger rolling mandrel which also tapers.

2. Description of the Related Art

For certain applications such, for example, as for improving the transfer of heat and flow conditions in heat exchangers and pipes, tubes are required to have an internal surface with helical ribbing for guiding the flow therethrough. For these applications, the ribbing is preferably fine-toothed such, for example, as having 60 ribs at a lead angle of approximately 20° the ribbing preferably has a relatively small depth.

Suitable materials for these pipes and tubes which require the internal ribbing include all metallic materials, including steel.

The helical internal ribbing for copper material pipes and tubes has been produced in drawing lines using a suitably helical drawing mandrel.

This method of producing the internal ribbing in drawing lines is applicable to relatively soft materials and thin-walled tubes such, for example, as copper tubes. However other materials which are difficult to form can only be ribbed to a limited extent or with a simple rib geometry.

SUMMARY OF THE INVENTION

The object of the present invention is to provide a tool for producing an internally ribbed tube made of a relatively high strength material with little outlay on machinery and acceptable mechanical loads on a cold pilger rolling mill while avoiding the above-described drawbacks.

The object is achieved according to the present invention by a tool comprising a cold pilger rolling mandrel having an extension plug at its free end mounted coaxially and rotatably and in which the negative of the helical internal ribbing which is to be produced is machined. The freely rotatable extension plug scarcely restricts the flow of material, because the torsional forces of the material are compensated for by the rotation of the extension plug. The advance of the material in the cold pilger rolling mill causes the extension plug to automatically adjust itself to the requirements of the tool in accordance with its helical lead angle, resulting in the formation of an undistorted ribbed inner surface of the tube.

The functional principle of the process according to the invention is divisible into two parts as follows: during the actual rolling or advancing of the material being rolled, i.e., the tube, into the area of the entry dead center position and during stretching over the actual smooth rolling mandrel, the material being rolled is pushed forward in the area of the ribbed extension plug. The external diameter of the extension plug is preferably slightly less than the internal diameter of the smooth tube received from the cold pilger rolling mandrel so that a length of smooth tube may be passed into the area of the plug. In the second part of the process, the rolls of the roll stand then press the material being rolled into the extension plug profile without any reduction in cross section. If the material being rolled is rotated in the exit dead center position and the roll design in the area of the plug is provided with a suitably large free surface, a release effect is brought about at the beginning of the return travel, which enables the material being rolled to be pushed over the helically ribbed extension plug in the next working cycle.

In a preferred configuration of the invention, the external diameter of the extension plug is greater than the internal diameter of the smooth tube by at most 50% of the depth of the ribs in the internal ribbing. This is because the conditions most favorable to forming the ribbing are produced if the external diameter of the extension plug is smaller than the internal diameter of the smooth tube, or at most only slightly greater. Otherwise, the tensile forces in the connection between rolling mandrel and plug may become unacceptably high and the material may become squeezed in the area of the extension plug.

In a further configuration of the invention, the roll design in the area of the extension plug is such that the cross-sectional area of the tube does not undergo any significant changes at this point. The diameter of the tube is only reduced over the extension plug until the required ribbing has been formed in the internal surface of the tube.

In design terms, it is proposed that the extension plug is rotatably mounted on a pin arranged in a floating position on the end of the cold pilger rolling mandrel. A side of the cold pilger rolling mandrel remote from the extension plug is supported against an axial bearing. In a simple structure, a bolt provided with a screwthread at the end may be screwed into a mating thread on the end side of the cold pilger rolling mandrel. The extension plug may be mounted in a freely rotatable manner on the bolt such, for example, as by sliding-contact bearings. The bolt may also be provided with a hexagonal head with an axial ball bearing accommodated between this head and the end of the extension plug facing away from the cold pilger rolling mandrel. The axial ball bearing is required for absorbing the high deformation forces of the tube which act axially on the bolt via the ribbed extension plug and thus to ensure that the extension plug rotates freely.

The present invention allows cold pilger rolling the formation of internal ribbing to be effected in a single operation, with practically no limits on the thickness of the tube wall. In the present invention, the ribbed profile is not distorted by simultaneous stretching as has occurred in some instances with ribbed conventional cold pilger rolling mandrels. The device is extremely economical and can be integrated in any cold pilger rolling mill with low additional investment costs.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The drawing is a longitudinal sectional view of a cold pilger rolling tool according to an embodiment of the present invention.

DETAILED DESCRIPTION OF THE PRESENTLY PREFERRED EMBODIMENTS

The figure shows a highly simplified illustration of a tool according to the invention. Rolls of a tapered design roll over a cold pilger rolling mandrel 1 and, by way of a bore diameter profile 2, produce the roll nip profile 3 which substantially reflects the reduction in the cross section of a tube 5 being worked on. According to the present invention, an extension plug 4 having a ribbed profile 4*a* corresponding to a negative of the profile to be produced in the tube 5 is connected to the cold pilger rolling mandrel 1 so that the extension plug 4 is freely rotatable relative to the cold pilger rolling mandrel 1. The roll nip profile 3 shown in the Figure corresponds to the geometric situation in which the cold pilger rolling stand is situated at the entry dead center position, before an advancing mechanism for the tube becomes active. From the position shown the Figure, the tube billet is first advanced, and the extension then takes place on the forwards travel. During this process, the material of the tube 5 situated in the area of influence of the extension plug 4 is also advanced. During the advancement of the tube 5, the extension plug 4 rotates in accordance with the lead angle of its ribbed profile 4*a*. The outer diameter of the extension plug 4 is selected to be smaller than the smoothing part of the actual rolling mandrel 1 (the inner diameter of the material received from the cold pilger rolling mandrel 1). Alternatively, the outer diameter of the extension plug may be greater than the internal diameter of the material received from the cold pilger rolling mandrel 1 by less than or equal to 50% of the radial depth of the ribs. Accordingly, only a small amount of material has to flow into the ribbed profile in the transitional zone 6. The frictional resistance of the tube 5 in the ribbed area is minimized as a result of the fact that the tube 5 is rotated in the exit dead center position and the free surface in this area is large enough to bring about sufficient expansion.

A bolt 7 is arranged on the cold pilger rolling mandrel 1 for attaching the extension plug 4. The bolt 7 is passed through a central hole in the extension plug 4 into a free end of the cold pilger rolling mandrel 1. The extension plug 4 is freely rotatable on the bolt 7 via at least one sliding-contact bearing 8 (two are shown in the figure). An axial bearing 9 is arranged on the bolt 7 at an end of the extension plug 4 remote from the cold pilger rolling mandrel 1. The axial bearing 9 is supported against a head 7*a* of the threaded bolt 7. The axial forces acting on the bolt 7 during production of the internal ribbing are absorbed via the axial bearing 9.

The invention is not limited by the embodiments described above which are presented as examples only but can be modified in various ways within the scope of protection defined by the appended patent claims.

We claim:

1. A cold pilger rolling tool for producing internally ribbed tubes using a cold pilger step rolling process in a rolling stand having rolls of a tapered design, the roll stand being movable back and forth in a direction of rolling so that the rolls roll over a material to be rolled with an alternating direction of rotation, said cold pilger rolling tool comprising:

a cold pilger rollins mandrel having a tapered profile and having a free end; and an extension plug coaxially and freely rotatably mounted on said free end of said cold pilger rolling mandrel and having a ribbing comprising a negative of a helical internal ribbing to be formed in the material to be rolled, wherein an external diameter of said extension plug is greater than the internal diameter of the material to be rolled received by said extension plug from said cold pilger rolling mandrel by less than or equal to 50% of a radial depth of said ribbing on said extension plug.

2. The cold pilger rolling tool of claim 1, wherein a roll design in an area around said extension plug is operatively designed so that a cross-sectional area of the material to be rolled is substantially constant as the material to be rolled passes over said area around said extension plug.

3. The cold pilger rolling tool of claim 1, further comprising:

a pin arranged at said free end of said cold pilger rolling mandrel, wherein said extension plug is rotatably mounted on said pin; and an axial bearing arranged on said pin on a side of said extension plug remote from said cold pilger rolling mandrel for supporting said extension plug.

4. A cold pilger rolling tool for producing internally ribbed tubes using a cold pilger step rolling process in a rolling stand having rolls of a tapered design, the roll stand being movable back and forth in a direction of rolling so that the rolls roll over a material to be rolled with an alternating direction of rotation, said cold pilger rolling tool comprising:

a cold pilger rolling mandrel having a tapered profile and having a free end; and an extension plug coaxially and freely rotatably mounted on said free end of said cold pilger rolling mandrel and having a ribbing comprising a negative of a helical internal ribbing to be formed in the material to be rolled, said extension plug being operatively arranged so that the rolls of the cold pilger rolling stand roll over both said tapered profile of said mandrel and said extension plug to form the helical internal ribbing while reducing the material to be rolled via cold pilger rolling.

* * * * *